US005253776A

United States Patent [19]

Decroix et al.

[11] Patent Number: 5,253,776

[45] Date of Patent: Oct. 19, 1993

[54] TRANSPORT AND STORAGE CONTAINER WITH SHEET-METAL FLOOR

[75] Inventors: Claude Decroix, Saverne; Francis Herrmann, Mittelbronn, both of France

[73] Assignee: Sotralentz S.A., Drulingen, France

[21] Appl. No.: 886,697

[22] Filed: May 20, 1992

[30] Foreign Application Priority Data

May 25, 1991 [DE] Fed. Rep. of Germany ..... 4117159

[51] Int. Cl.[5] ..... B65D 19/10

[52] U.S. Cl. ..... 220/495; 220/403; 220/625; 220/1.5

[58] Field of Search ..... 206/386, 503, 509, 513, 206/386; 220/401, 403, 9.1, 1.5, 494, 495, 620, 625, 668, 676

[56] References Cited

U.S. PATENT DOCUMENTS

| | | | |
|---|---|---|---|
| 824,566 | 6/1906 | Moss | 220/495 |
| 1,187,749 | 6/1916 | Lane | 220/401 |
| 2,317,044 | 4/1943 | Faulkner | 220/294 |
| 2,721,671 | 10/1955 | Averill | 220/494 |
| 2,968,418 | 1/1961 | Stoddard | 206/513 |
| 3,333,722 | 8/1967 | Panknin | 220/495 |
| 3,348,723 | 10/1967 | Wilson | 220/495 |
| 4,909,387 | 3/1990 | Schutz | 220/401 |
| 4,947,988 | 8/1990 | Schutz | 220/401 |
| 5,002,194 | 3/1991 | Nichols | 220/401 |
| 5,050,765 | 9/1991 | Roser et al. . | |
| 5,058,747 | 10/1991 | Decroix et al. | 220/9.1 |
| 5,110,000 | 5/1992 | Nichols | 220/403 |
| 5,111,937 | 5/1992 | Schutz | 206/386 |

FOREIGN PATENT DOCUMENTS

| | | | |
|---|---|---|---|
| 158998 | 10/1985 | European Pat. Off. | 206/386 |
| 2224137 | 11/1973 | Fed. Rep. of Germany | 206/386 |
| 3907717 | 9/1990 | Fed. Rep. of Germany | 220/401 |
| 515989 | 12/1939 | United Kingdom | 220/495 |

*Primary Examiner*—Allan N. Shoap
*Assistant Examiner*—S. Castellano
*Attorney, Agent, or Firm*—Herbert Dubno; Andrew Wilford

[57] ABSTRACT

A transport and storage container has an annular and erect outer wall constituted as a grid of welded-together vertical and horizontal bars and having a lower edge provided with a lower-edge bar and an upper edge provided with an upper-edge bar, a normally horizontal and generally rectangular sheet-metal floor plate having an inwardly open C-section outer rim engaged over the lower-edge bar, and a flexible inner vessel enclosed by the outer wall and resting on the floor plate. The floor plate has four sides including two opposite sides formed with the C-section outer rim. In addition another of the sides is also formed with the C-section rim and a fourth side is free of the C-section rim and the fourth side of the floor plate is formed with outwardly projecting tabs that engage over the lower-edge bar. This makes assembling the container a simple matter of sliding the plate parallel to its opposite sides underneath the outer wall with the rims engaging over corresponding sections of the lower-edge bar until the tabs engage over and past at least one further section of the lower-edge bar. The tabs can be bend down over the fourth side to lock the assembly permanently together.

9 Claims, 4 Drawing Sheets

TRANSPORT AND STORAGE CONTAINER WITH SHEET-METAL FLOOR

FIELD OF THE INVENTION

The present invention relates to a storage and transport container. More particularly this invention concerns such a container having a rigid gridwork outer vessel in which is held an inner bladder or bag containing fluent material.

BACKGROUND OF THE INVENTION

In commonly owned U.S. Pat. No. 5,058,747 a container is described that has an annular and erect outer wall in the form of a gridwork of bars having a lower edge and provided at the edge with an annular stiffening bar and a pallet-like floor downwardly closing the wall, forming therewith an outer vessel, and provided with a plurality of wooden foot beams each having a ground-engaging lower surface, an upper surface, and a pair of ends. Respective steel plates on the upper surfaces of the foot beams each have bent-down ends overlying the respective beam ends. Fasteners such as screws or nails are engaged through the steel-plate ends into the respective beam ends. Integral connections are provided between each of the plates and the annular stiffening bar at the lower edge of the wall. An inner vessel composed of flexible plastic material is enclosed by the outer wall and supported on the floor.

This system is an improvement on that described in commonly owned U.S. Pat. No. 5,050,765 which has an outer side comprised of a plurality of vertical flat panels each formed by a gridwork of horizontal and vertical bars with the horizontal bars being interconnected with the panels forming an upwardly open rectangular-section tube. A generally rectangular bottom formed as a gridwork of horizontal bars has respective sides juxtaposed with the panels of the side and the vertical bars of the side have horizontally bent lower ends lying against respective bars of the bottom with at least some of the bent lower ends of adjacent panels of the side crossing one another. An inner vessel composed of a plastic material is enclosed by the outer side and supported on the bottom and respective welds secure together the crossing lower ends of the side and also secure the lower ends and the bars of the bottom together.

These systems are relatively efficient, allowing liquids or bulk fluent materials to be handled easily like normal solid freight. Nonetheless the containers are fairly difficult to manufacture and the critical joint region between the side walls and floors represents a particular problem, as this area is very heavily stressed in use. The system with wooden pallet feet is extremely stiff and vibration- and deformation resistant, but the feet tend to disintegrate fairly rapidly. The wholly metal system, even when it has integral metal feet, is extremely durable, but deforms somewhat easily and is not vibration resistant.

OBJECTS OF THE INVENTION

It is therefore an object of the present invention to provide an improved transport and storage container.

Another object is the provision of such an improved transport and storage container which overcomes the above-given disadvantages, that is which can be produced inexpensively, yet which is extremely durable, vibration resistant, and hard to deform.

SUMMARY OF THE INVENTION

A transport and storage container has according to the invention an annular and erect outer wall constituted as a gridwork of welded-together vertical and horizontal bars and having a lower edge provided with a lower-edge bar and an upper edge provided with an upper-edge bar, a normally horizontal and generally rectangular sheet-metal floor plate having an inwardly open C-section outer rim engaged over the lower-edge bar, and a flexible inner vessel enclosed by the outer wall and resting on the floor plate.

This container can be produced at extremely low cost. It will be very strong as the interconnection at the C-section rims will be capable of resisting even the enormous forces encountered during rough handling of the package.

According to the invention the floor plate has four sides including two opposite sides formed with the C-section outer rim. In addition another of the sides is also formed with the C-section rim and a fourth side is free of the C-section rim and the fourth side of the floor plate is formed with outwardly projecting tabs that engage over the lower-edge bar. This makes assembling the container a simple matter of sliding the plate parallel to its opposite sides underneath the outer wall with the rims engaging over corresponding sections of the lower-edge bar until the tabs engage over and past at least one further section of the lower-edge bar. The tabs can be bend down over the fourth side to lock the assembly permanently together.

Furthermore according to the invention the floor plate is provided with a plurality of welded-on metal feet forming fork-receiving horizontal passages and a lower floor plate beneath the first-mentioned floor plate is fixed thereto at least at the feet. In addition the floor plate has an inset lower edge that can fit within the upper-edge bar of another such container. This makes it possible to handle the container with a fork lift like a pallet and to stack the containers with some nesting one atop the other.

For maximum vibration resistance and stiffness the plate is formed with stiffening formations constituted as a plurality of three-dimensional stiffening ribs. The ribs are formed at an outer periphery of the plate and also extend diagonally of the plate. In addition the plate is provided across a central region with a stiffening bar which is welded underneath the plate.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
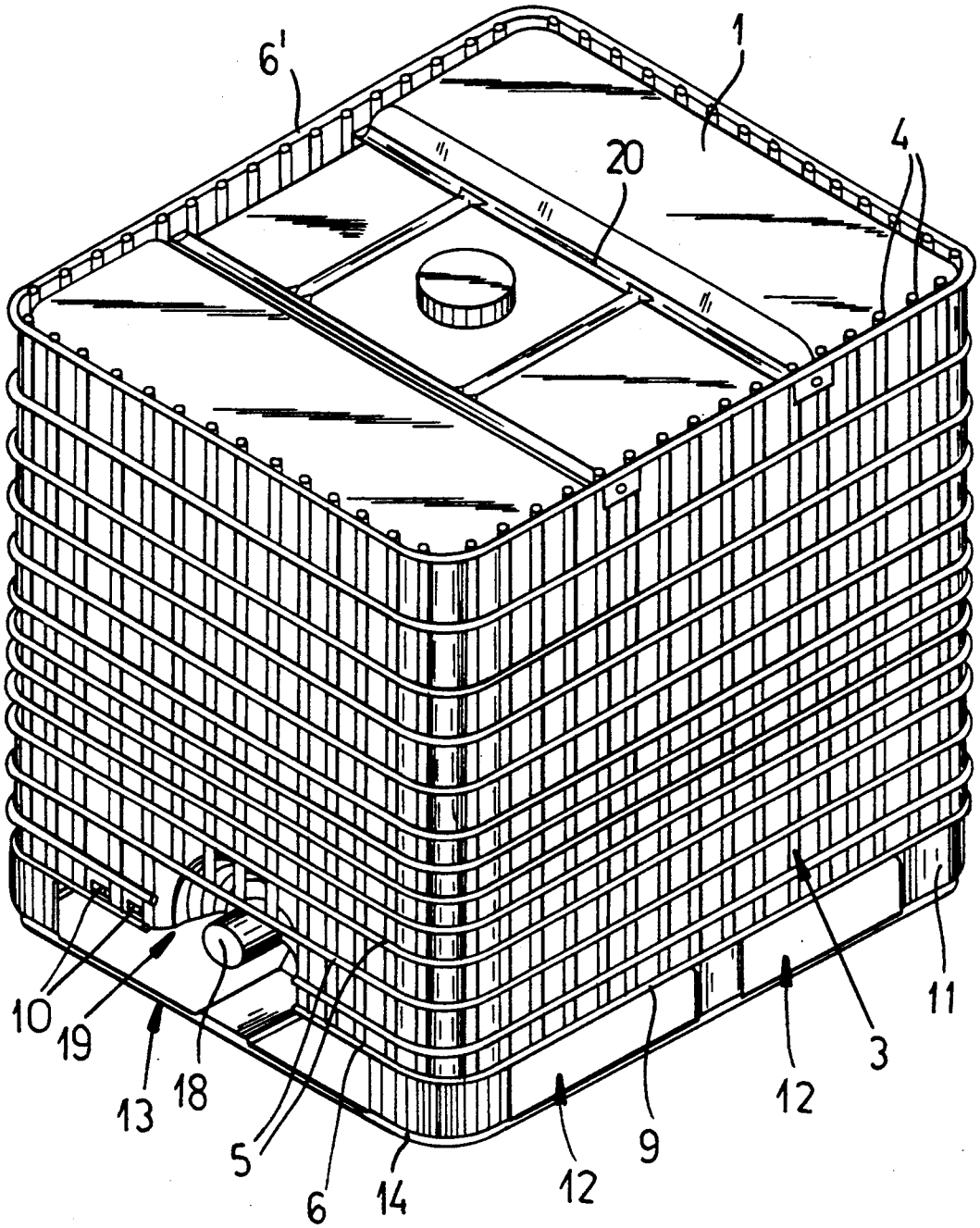
FIG. 1 is a perspective view of the container according to the invention.
Figure 2:
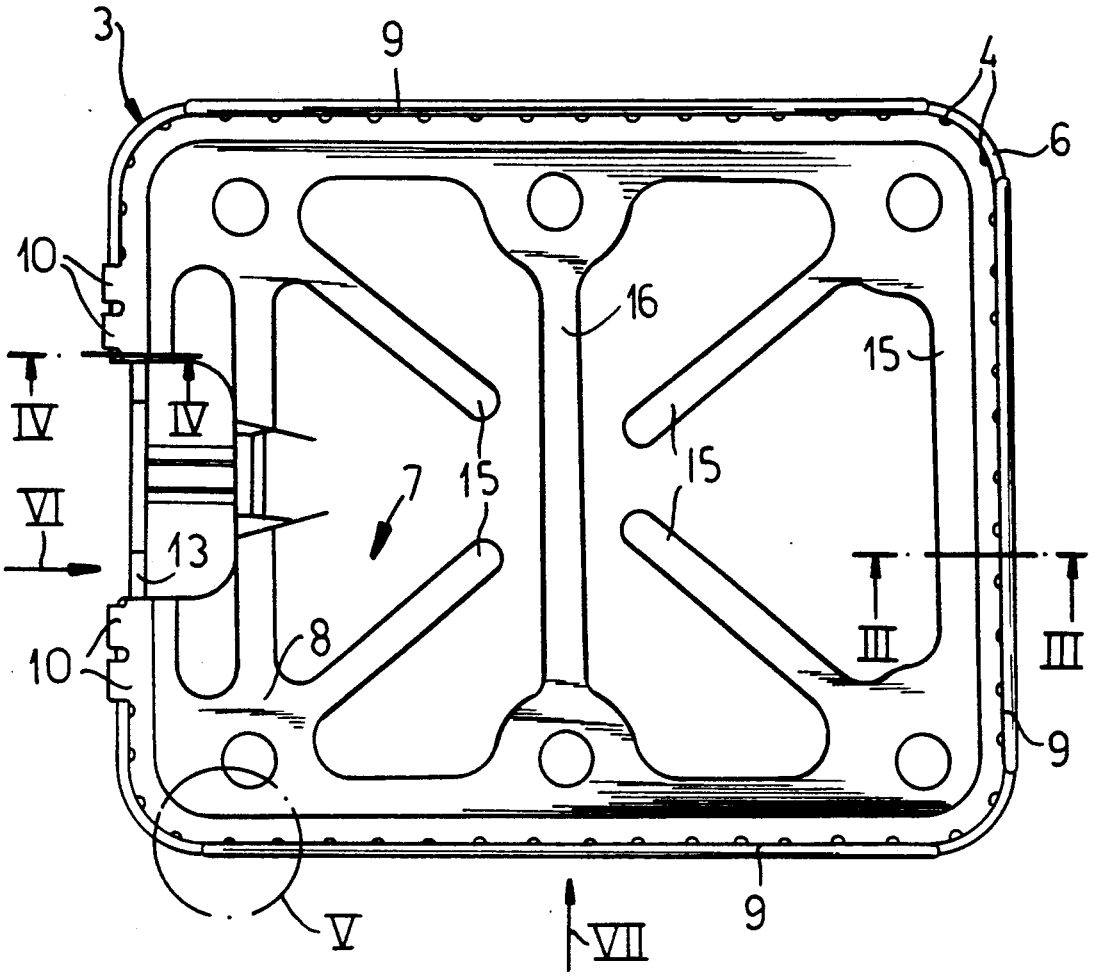
FIG. 2 is a top view of the container with the inner vessel removed for clarity of view.

As seen in FIGS. 1 and 2 a container according to this invention basically comprises a standard inner vessel 1 formed as a synthetic-resin blow-molded bag or bladder and contained in an outer vessel formed by a horizontal floor 2 of rounded-corner rectangular shape and an erect and annular side wall 3 formed of vertical round-section bars 4 and horizontal round-section bars 5 welded together in a gridwork. The horizontal bars 5 are annular and of the same shape as the outer edge of the floor 2 and the vertical bars 4 are welded at their upper ends to a round-section steel upper-edge bar 6' and at their lower ends to a round-section steel lower-edge bar 6. This construction is generally standard and corresponds to that of above-cited U.S. Pat. No. 5,058,747.

Figure 4:
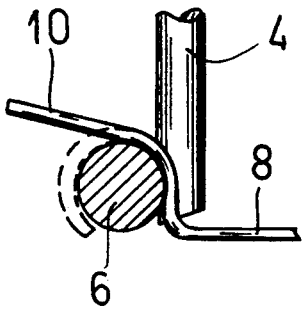
FIGS. 3 and 4 are large-scale sections taken along respective lines III—III and IV—IV of FIG. 2.
Figure 3:
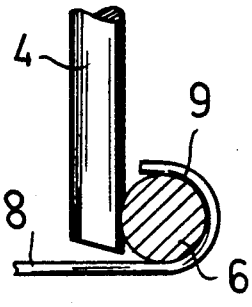
Figure 5:
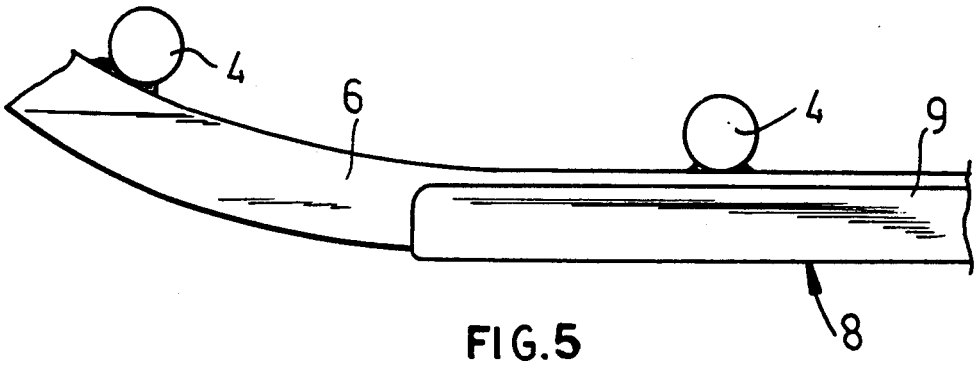
FIG. 5 is a large-scale view of the detail indicated at V in FIG. 2.
Figure 6:
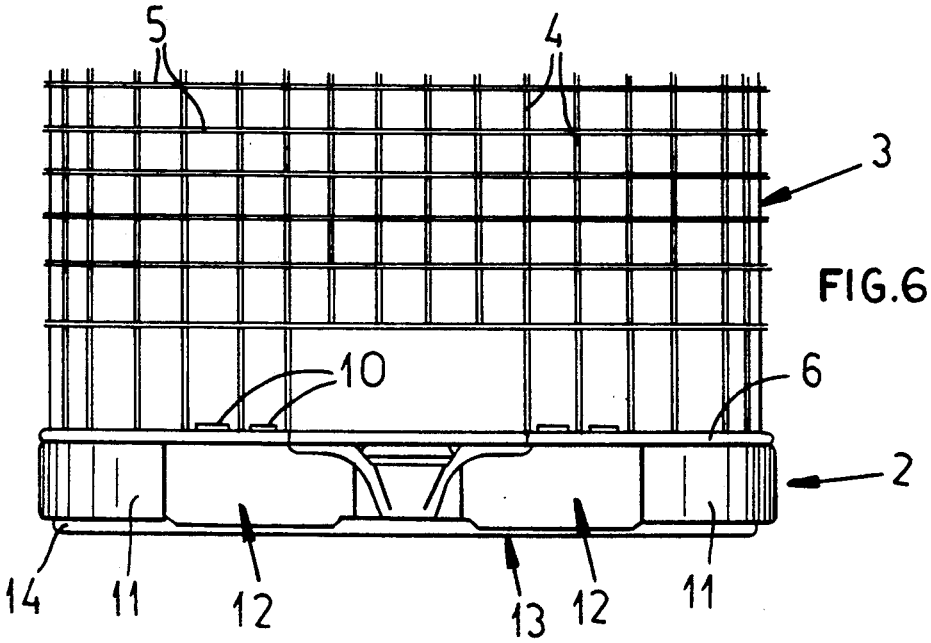
FIGS. 6 and 7 are front and side views taken in the directions of respective arrows VI and VII of FIG. 2 of the lower portion of the container.
Figure 7:
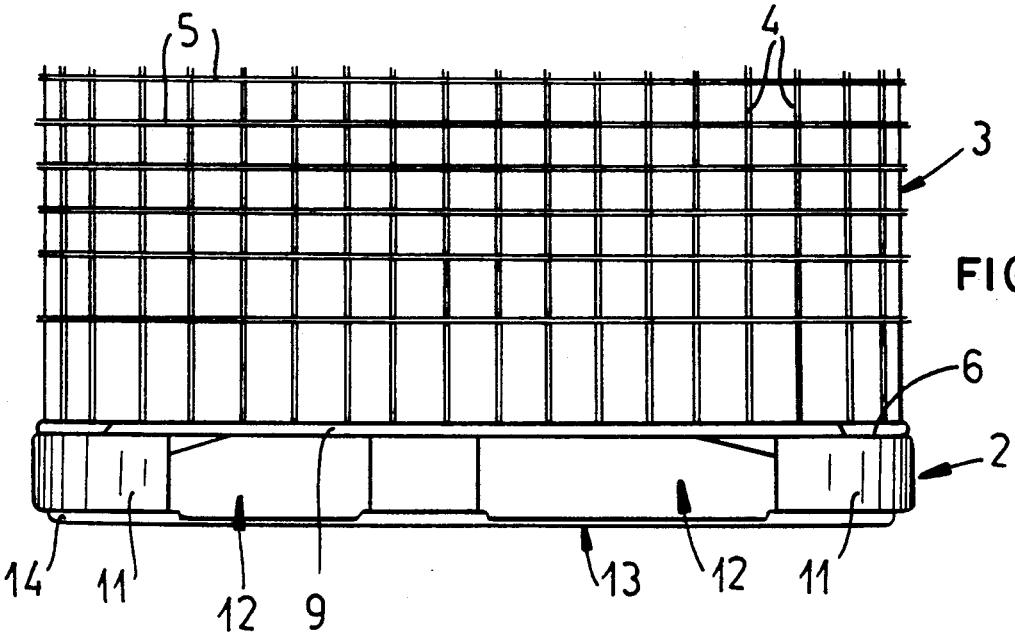
Figure 8:
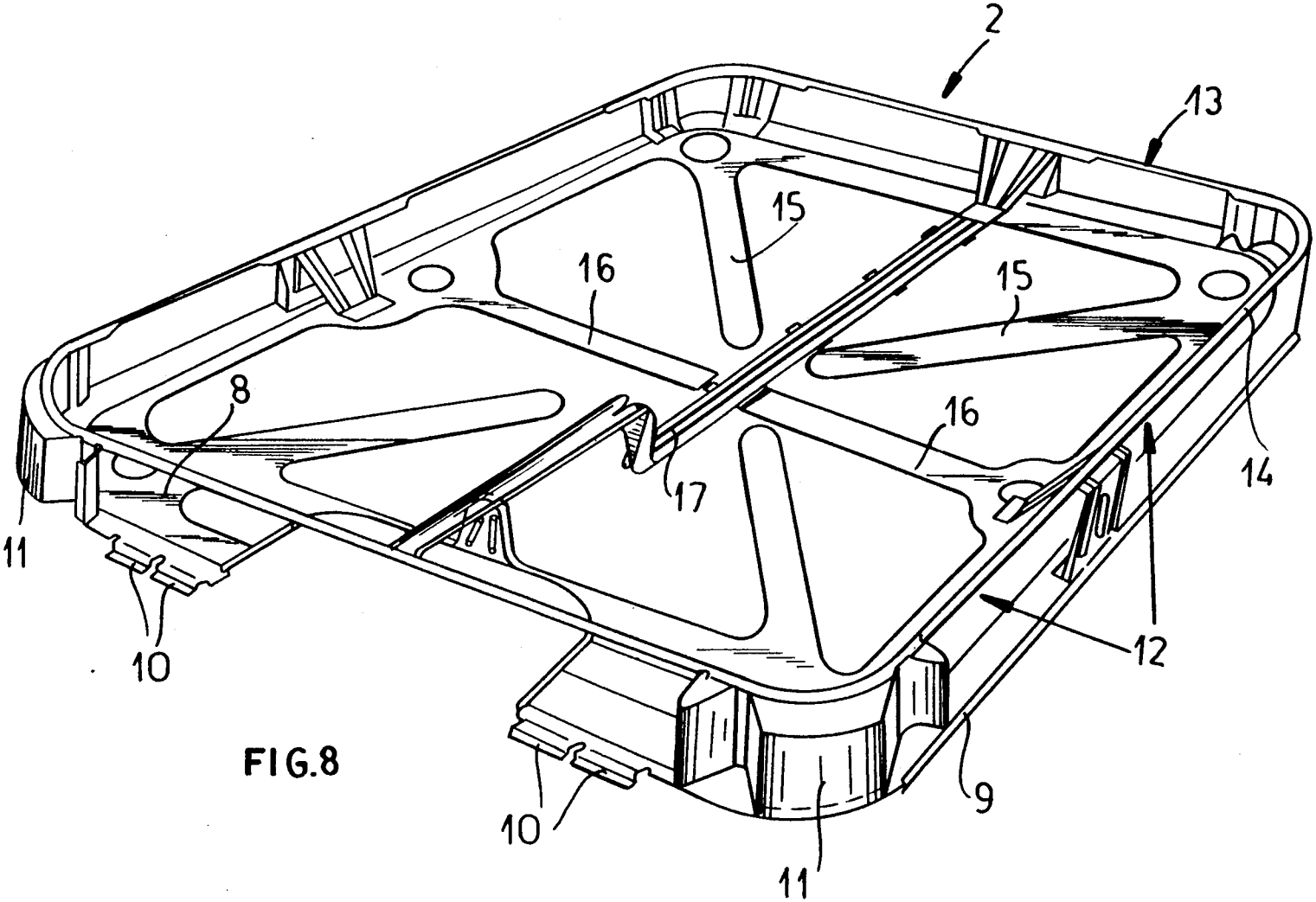
FIG. 8 is a perspective bottom view of the floor of the container.

The floor 2 is formed mainly by an upper rectangular sheet-metal plate 8 having four edges, three of which are bent up into C-section rims 9 and one of which forms outwardly projecting tongues 10 shown respectively in FIGS. 3 and 4. Welded to the underside of the plate 8 at the corners thereof are feet 11 forming tine-receiving passages 12 and another lower plate 13 may in turn be welded under the feet 11. The floor 2 has an inset lower edge 14 so the containers can be set one atop the other with the inset edge 14 nested in the upper rail 6' of the underlying container. In addition the plate 8 is formed with peripheral and diagonal stiffening ribs 15 and with a transverse stiffening rib 16 that prevent it from deforming or rattling when vibrated. A further stiffening rail shown at 17 in FIG. 8 is welded across underneath the plate 8 parallel to the long sides of this plate 8 and across the bridging rib 16.

The container described above is assembled by sliding the floor 2 parallel to its long sides, that is from the right in FIG. 2, underneath the side wall 3 with the long-wall rims 9 engaging over the corresponding sections of the lower-edge bar 6 until the short-wall rim 9 engages over that section of the bar 6. Meanwhile the tabs or tongues 10 will poke out over the opposite short-wall section of the bar 6 where they may be bent down as indicated at dashed lines in FIG. 4 to permanently secure the assembly together. Then the bladder 1 is set in place with its nozzle 18 exposed through a gap 19 in the lower portion of one of the short walls, and a stabilizing frame or ladder 20 is secured crosswise across the top of the side wall 3.

The resultant assembly is extremely durable and light. A fork lift can insert its fork tines through the gaps 12 between the feet 11 to manipulate the container, and the containers can be stacked in a partial nesting arrangement that is very stable.

We claim:

1. A transport and storage container comprising:

an annular and erect outer wall constituted as a gridwork of welded-together vertical and horizontal bars and having a lower edge provided with a lower-edge bar and an upper edge provided with an upper-edge bar;

a normally horizontal and generally rectangular sheet-metal floor plate having first, second, third, and fourth sides, the first, second, and third sides each being formed with an inwardly open C-section outer rim engaged over the lower-edge bar and the fourth side being free of such a C-section rim and being formed with outwardly projecting tabs that engage over the lower-edge bar; and a flexible inner vessel enclosed by the outer wall and resting on the floor plate.

2. The transport and storage container defined in claim 1 wherein the floor plate is provided with a plurality of welded-on metal feet forming fork-receiving horizontal passages.

3. The transport and storage container defined in claim 5, further comprising a lower floor plate beneath the first-mentioned floor plate and fixed thereto at least at the feet.

4. The transport and storage container defined in claim 1 wherein the floor plate has an inset lower edge that can fit within the upper-edge bar of another such container.

5. The transport and storage container defined in claim 1 wherein the floor plate is formed with stiffening formations.

6. The transport and storage container defined in claim 5 wherein the stiffening formations include a plurality of three-dimensional stiffening ribs.

7. The transport and storage container defined in claim 6 wherein the ribs are formed at an outer periphery of the floor plate and also extend diagonally of the floor plate.

8. The transport and storage container defined in claim 5 wherein the floor plate is provided across a central region with a stiffening bar.

9. The transport and storage container defined in claim 8 wherein the stiffening bar is welded underneath the floor plate.

* * * * *